United States Patent [19]

Hyland et al.

[11] Patent Number: 4,615,470

[45] Date of Patent: Oct. 7, 1986

[54] VALVE ASSEMBLY FOR CONTAINER OF PRESSURIZED FLUID

[75] Inventors: John G. Hyland, Rowlands Castle; Ronald P. Clement, Portsmouth, both of England

[73] Assignee: Aerosol Inventions & Development S.A. AIDSA, Fribourg, Switzerland

[21] Appl. No.: 630,767

[22] Filed: Jul. 13, 1984

[30] Foreign Application Priority Data

Jul. 16, 1983 [GB] United Kingdom ..... 8319353

[51] Int. Cl.[4] ..... B65D 83/14

[52] U.S. Cl. ..... 222/402.16; 222/402.24

[58] Field of Search ..... 222/402.16, 402.1, 402.24; 251/354, 353, 349

[56] References Cited

U.S. PATENT DOCUMENTS

| | | | |
|---|---|---|---|
| 3,081,916 | 3/1963 | Rhodes et al. | 222/402.16 |
| 4,015,752 | 4/1977 | Meuresch et al. | 222/402.16 |
| 4,503,999 | 3/1985 | MacNair et al. | 222/402.16 |

FOREIGN PATENT DOCUMENTS

| | | | |
|---|---|---|---|
| 2625376 | 12/1976 | Fed. Rep. of Germany | 222/402.16 |
| 2556165 | 6/1977 | Fed. Rep. of Germany | 222/402.16 |
| 2040002 | 8/1980 | United Kingdom | 222/402.16 |
| 2058229 | 4/1981 | United Kingdom | 222/402.16 |

*Primary Examiner*—Charles A. Marmor

*Attorney, Agent, or Firm*—Scrivener Clarke Scrivener and Johnson

[57] ABSTRACT

In a valve assembly for a pressurized fluid dispensing container, such as those commonly known as aerosol cans, the filling with propellant gas at the very high speed and pressure needed to meet current production rates presents problems. The invention involves crimping the center boss of the sheet metal mounting cup in such a way, and at a point below the enlarged head portion of the valve housing, that the part of the boss above the crimp and around the valve housing bows outwards to provide clearance for "gassing". There are notches in the lower part of the outside of the head portion but these stop short of the upper face of the head. The valve stem may also have external axial grooves placed to increase the effective cross-sectional area during gassing.

4 Claims, 6 Drawing Figures

VALVE ASSEMBLY FOR CONTAINER OF PRESSURIZED FLUID

The invention relates to a valve assembly for a container for pressurised fluid, such as those containers commonly known as aerosol cans.

Valves for this purpose usually comprise a disc-like gasket of flexible, resilient material mounted against the underside of a top wall of a central upstanding boss in a valve mounting cup of sheet metal, with a valve member having an annular surface urged against the lower face of the gasket by a spring assisted by the pressure within the container, a hollow valve stem projecting upwards through a central hole in the gasket, the gasket forming a sliding seal on the stem, and downward movement of the stem causing the annular surface of the valve member to move partially or bodily away from the gasket and an outlet path for the product through the stem to open, the valve member being enclosed in a housing having coaxial tubular head and body portions, the head being of larger diameter than the body, the housing being secured in place by inward crimping of the cylindrical wall of the boss at a number of points beneath the head portion of the housing contacting the lower edge of the head portion but leaving a space between the crimp and the body portions, this crimping not only clamping the shell in place but also trapping the periphery of the gasket in normal use between the rim of the head portion of the housing and the underside of the top wall of the boss. Such a valve assembly is hereinafter referred to as "of the kind set forth".

To fill the container initially with the necessary gas under pressure (so called "gassing") it is usual to pass the gas through the valve assembly itself. The stem is depressed to open the valve and the gas passes partly through the stem itself, i.e. in the reverse of the path followed during dispensing, but because of the small cross-section of parts of this path, gassing by this path alone would be unacceptably slow. In practice gas flows also through the annular gap between the valve stem and the opening in the top wall of the mounting cup through which it protrudes, and then deflects the inner part of the flexible gasket downwards away from the stem, so that the gas can then pass down through the valve housing and into the interior of the container. However even this path is restricted, especially where there is the usual relatively narrow-bore dip tube on the bottom end of the valve housing, and so there is a further path. This is a path resulting from the pressure of the gas compressing the gasket downwards, so that the gas can flow radially outwards between the top surface of the gasket and the underside of the top wall of the central boss of the mounting cup, and then down around the outside of the housing, between the housing and the inside wall of the central boss.

There is a continuous desire to increase the speed of production of filled aerosol cans by reducing the time taken for "gassing". The problem has also been aggravated by the partial switch from fluoro-hydrocarbon mixtures to carbon dioxide as the propellant gas. There are basically two ways in which the gassing can be speeded up; first by increasing the pressure at which it is performed and, second, by increasing the cross-sectional area of the path through which the gas flows. The first has led to pressures of up to 88 bar, which is near the limit that can be reached without simply blowing the valve assembly apart; this means that special attention has to be paid to ensuring that the housing is crimped securely into the central boss of the mounting cup. To improve the area of the path for flow various measures are known, including increasing the clearance around the stem, if necessary by the use of notches, and of providing notches in the periphery of the gasket and/or of the head of the valve housing. Examples of earlier proposals on these lines are shown in British Patent Specifications Nos. 1 165 081, 1 362 885 and 1 516 136 on the present applicants, as well as Nos. 1 358 181 and 1 532 492 of Precision Valve Corporation. A recent proposal is that disclosed in British Patent Application No. 2 104 597 of Metal Box plc.

A drawback of these notches in the head of the valve housing is that they reduce the effectiveness with which the housing clamps the periphery of the gasket against the top wall of the central boss of the valve mounting cup, and consequently they can reduce the security against leakage in storage and use. It is the principal aim of the present invention to provide as good as possible a flow path for gassing, but without detracting from the effectiveness of the seal.

According to the invention we provide a valve assembly of the kind set forth in which the crimps are arranged sufficiently high relative to the housing, but below the head of the housing, and are sufficiently tight, to cause the sheet metal of the boss around the head portion of the housing to bow outwardly away from the head portion upon crimping, and a clearance is left between the body portion of the housing and the crimped boss. This ensures that a flow path exists for gassing purposes between the top of the gasket and the side of the head portion of the housing, and around the body portion of the housing. The head portion of the valve housing is preferably provided with axially-extending slots of sufficient number and sufficiently small cross-section to ensure that in the assembled valve, during gassing, the flow path provided by the slots is not significantly blocked by the crimps. In a preferred embodiment the slots do not open at their upper extremities into the upper surface of the head portion of the housing but rather open at an area on the cylindrical face of the head portion. This ensures that the pressure on the gasket exerted by the housing in use is uniform over the area of the rim of the housing, and eliminates micro-leakage of the contents through any exposed area of the underside of the gasket. Any number of slots may be provided, provided the condition of sufficient number is met, though a typical number of slots is twenty.

As a further step to improve the flow path, but without adding to the danger of the valve stem tilting in normal use, we arrange that the outside surface of the stem of the valve is provided with one or more axially extending grooves at that region of its axial length which lies in the opening in the top wall of the mounting cup when the valve stem is depressed to the position used for gassing.

The grooves are preferably of a size and number such that the cross-section for flow around the stem, though larger than in most known arrangements, is not more than, and is preferably a little less than, the minimum cross-section around the outside of the head of the housing. In this way, the gassing operation can be carried out at high pressure without excessive build-ups of pressure within the assembly which may cause damage to the assembly.

An embodiment of the invention will now be described, by way of example only, with reference to the accompanying drawings, of which:

Figure 1:
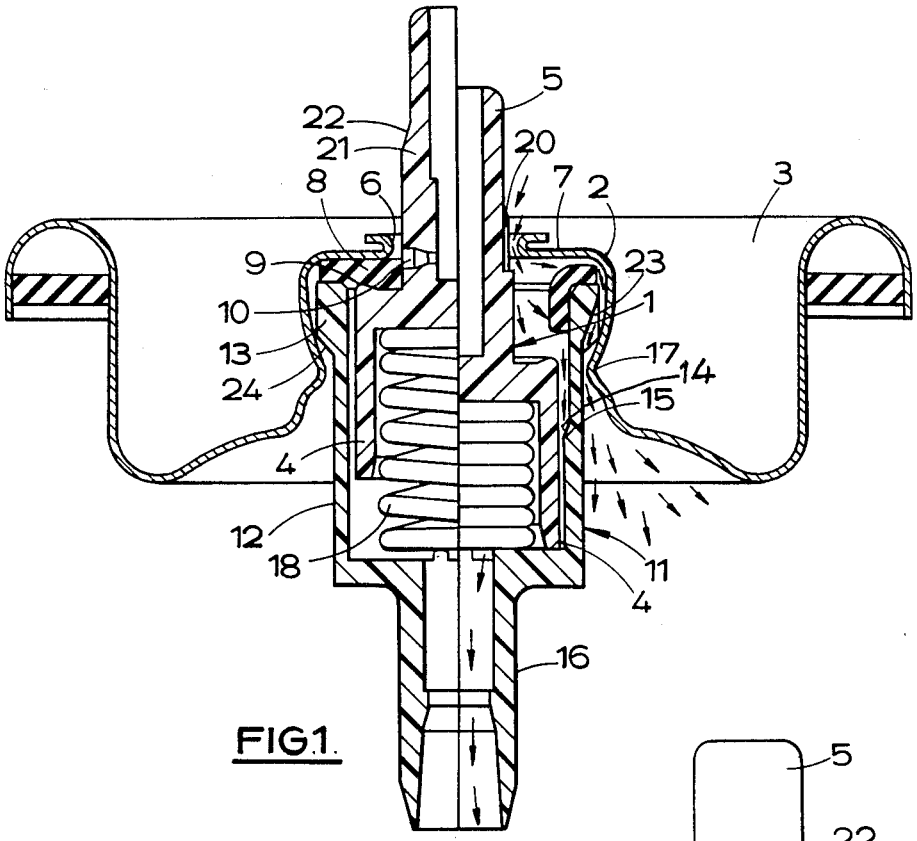
FIG. 1 is a cross-sectional view of a valve assembly according to the invention, the left-hand side of the Figure showing the valve assembly in the closed condition of normal use, and the right-hand side of the Figure showing the valve assembly in the open configuration assumed during the gassing operation.

FIG. 1 shows a valve assembly comprising a valve shown generally at 1 mounted in a central upstanding boss 2 of a sheet metal mounting cup 3 which is adapted to fit onto an aerosol can (not shown) in a manner that is well known. The valve 1 comprises a valve member 4 in the form of an inverted cup surmounted by an integral upstanding hollow stem 5. The stem 5 projects through a central opening 6 in the top wall 7 of the boss 2 and through a flat annular gasket 8 of synthetic rubber located against the underside of the top wall 7. The opening 6 is a little larger in diameter than the stem 5, but the gasket 8 forms a tight sealing fit against the stem. An annular bead 9 formed at the outer edge of the upper face of the valve member 4 cooperates with the underside of the gasket 8 to form a seal. A radial hole 10 extends outwards through the wall of the hollow stem 5 at a level which is just above the lower face of the gasket 8 when the bead 9 is sealed against the gasket 8, as shown in the left-hand side of FIG. 1. On downward movement of the valve stem 5 the seal formed by the bead 9 breaks and the radial hole 10 moves down relative to the gasket 8 to open and communicate with the space below the gasket 8 thus opening the valve and putting the hollow interior of the stem 5 in communication with the interior of the valve.

The valve member 4 is enclosed in a hollow, substantially cylindrical housing 11 having a body portion 12 and an upper head portion 13 of greater external diameter than the body portion. The internal diameter of the housing 11 is a little greater than the outer diameter of the valve member 4 so that a restricted fluid flow path 14 exists between the two. The valve member 4 is guided for co-axial movement within the housing 11 by axially extending internal radial projections 15 provided at circumferential intervals within the housing 11.

A hollow spigot 16, leading from the interior of the housing 11 extends from the lower end of the body portion 12 of the housing and is fitted with a conventional dip tube (not shown). The upper end of the head portion 13 of the housing 11 is open and seals against the underside of the gasket 8, the housing 11 being retained in the boss 2 by crimping the boss in eight circumferentially symmetrically spaced regions around the housing beneath the head portion 13 as indicated at 17. A helical coil spring 18 is carried in the housing 11 to urge the valve member 4 upwards to seal the annular bead 9 against the gasket 8.

Figure 2:
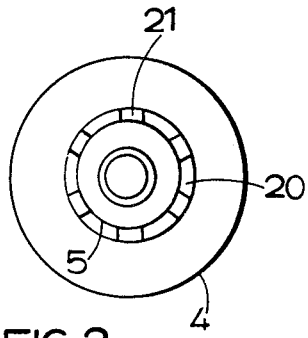
FIG. 2 is a plan view of the valve member of the valve assembly of FIG. 1.
Figure 3:
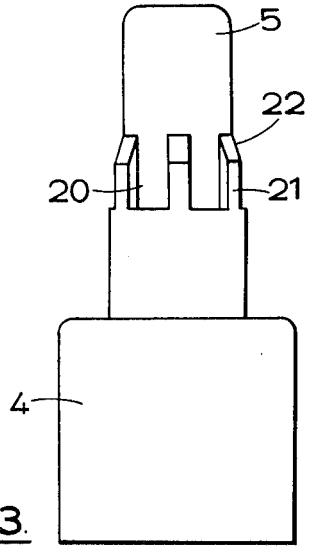
FIG. 3 is a side view of the valve member of FIG. 2.

The valve assembly so far described is basically of a known form and acts in a known manner. In the assembly illustrated, however, the stem 5 is provided with six grooves 20 as shown in FIGS. 2 and 3. The grooves are arranged so that in the gassing position shown in the right-hand side of FIG. 1 they increase the cross-sectional area of the fluid flow path between the stem 5 and the edge of the opening 6. The lower extremities of the grooves are located such that they cannot in normal use be pushed below the level of the lower edge of the gasket 8 causing escape of the propellant. Ribs 21 between the grooves serve to prevent excessive tilting of the stem 5 in use, and at their upper extremities are tapered to provide a smooth shoulder 22 to aid assembly of the valve.

In the illustrated valve assembly according to the invention, the crimps 17 are arranged in a higher than usual position relative to the housing 11 and are somewhat tighter than is usual in valves of this construction. The crimps 17 are sufficiently tight and are arranged sufficiently high relative to the housing 11 to cause the sheet metal of the boss around the head portion 13 of the housing 11 to pivot about the lower outer extremity of the cross-section of the head portion 13 and consequently to bow outwardly above this point on crimping as shown in FIG. 1. The crimps 17 actually contact the housing 11 below the head portion 13, leaving a clearance between the body portion 12 of the housing 11 and the crimped boss, ensuring the existence of a flow path for gassing purposes between the top of the gasket 8 and the side of the head portion 13 of the housing 11, and around the body portion 12 of the housing 11.

Figure 4:
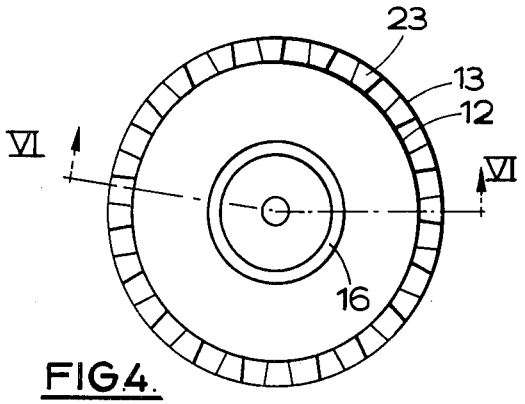
FIG. 4 is an underneath plan view of the housing of the valve assembly of FIG. 1.
Figure 5:
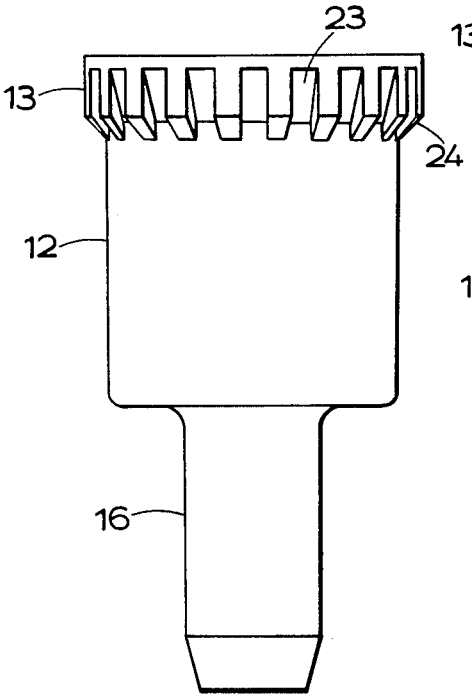
FIG. 5 is a side view of the housing of FIG. 4.
Figure 6:
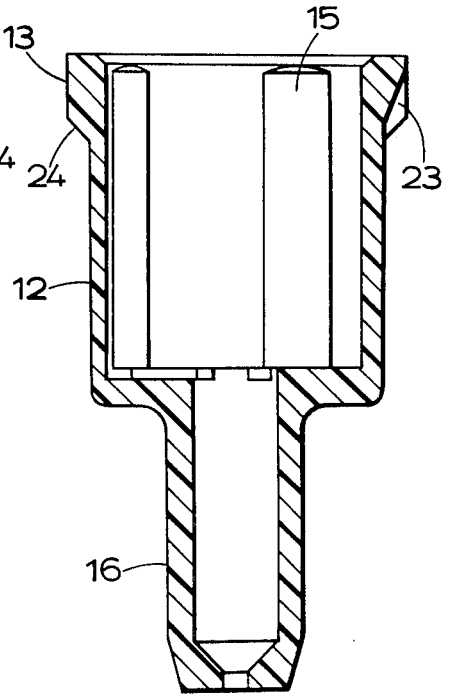
FIG. 6 is a cross-sectional view on line VI—VI of FIG. 4.

The head portion 13 of the housing 11 is provided with twenty axially-extending slots 23 as shown more particularly in FIGS. 4, 5 and 6. The slots 23 extend from the annular chamfered lower edge 24 of the head portion 13 only to a point well short of the upper edge of the head portion 13 in order to maximise the cross-sectional area of the flow path around the housing 11 during gassing without reducing the surface area of the top face of the housing which in use abuts the gasket 8. This ensures uniform pressure on the gasket and eliminates micro-leakage of the contents through exposed areas of the lower face of the gasket. The slots 23 are above the crimps 17 and are sufficiently small to ensure that the cross-sectional area of the flow path around the head is not significantly reduced by the crimps 17. The slots could extend further up the cylindrical wall of the outside of the head than those shown, as long as they do not actually break into the top surface of the head.

The sizes of the slots 20 and the slots 23 are chosen so that the minimum cross-sectional areas of the respective gassing flow paths around the stem 5 and around the housing 11 are substantially equal in order that the gassing operation can be performed at high pressure and hence at speed without incurring damaging pressure build-ups within the valve assembly. If anything, the cross-section of the path around the stem is made slightly less than that around the housing so that if the applied pressure is excessive, the main pressure drop is at the stem.

We claim:

1. In a valve assembly for a pressurised dispenser comprising a mounting cup center boss of sheet metal having a substantially cylindrical side wall and a top wall, an upwardly open valve housing terminating at its upper end in an annular thickened head portion, said housing being received within said boss, an annular gasket having its outer periphery trapped between said head portion and the underside of said top wall, a valve member resiliently urged against the underside of said gasket, and a hollow actuating and dispensing stem projecting upwards from said valve member through said gasket and said top wall, said cylindrical wall of said mounting cup center boss being crimped inwards at a plurality of circumferentially spaced points at a level below said thickened head portion of said valve housing to retain said housing in said center boss, and said head portion having in the periphery thereof a plurality of vertically extending slots forming part of a gassing path from a region above said gasket to a region below said head portion, the improvement wherein the inward crimping of said side wall is sufficiently high relative to said housing, but below said head portion, and is sufficiently tight, to cause a lower part of said side wall to engage a lower region of said head portion, and the upper part of said side wall above said engaged region to bow outwardly away from said head portion, said vertically extending slots lying in the lower part of the outside of said head portion but stopping short at their upper ends of that part of the head portion which engages said gasket whereby the outer periphery of said gasket is at all times fully supported by said gasket-engaging part of said head portion throughout its circumferential extent without interruption by said slots.

2. The improvement set forth in claim 1, wherein said slots are substantially greater in number than said crimping points.

3. The improvement set forth in claim 1 wherein there are axially extending grooves in the outside of said stem, separated by ribs, over that axial portion of said stem which lies in said top wall when said stem is depressed to a gassing position, the total cross-sectional area of said grooves being not greater than the total cross-sectional area of said slots.

4. The improvement set forth in claim 1 wherein said slots traverse the engaged region of said head portion.

* * * * *